US008669036B2

(12) United States Patent
Itou et al.

(10) Patent No.: US 8,669,036 B2
(45) Date of Patent: Mar. 11, 2014

(54) PRODUCING METHOD OF TONER

(75) Inventors: Tsuyoshi Itou, Shizuoka-ken (JP); Takahito Kabai, Shizuoka-ken (JP); Takayasu Aoki, Shizuoka-ken (JP); Masahiro Ikuta, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/222,796

(22) Filed: Aug. 31, 2011

(65) Prior Publication Data

US 2012/0082931 A1 Apr. 5, 2012

Related U.S. Application Data

(60) Provisional application No. 61/389,892, filed on Oct. 5, 2010.

(51) Int. Cl.
*G03G 5/00* (2006.01)

(52) U.S. Cl.
USPC ..... 430/137.15; 430/137.1

(58) Field of Classification Search
USPC ..... 430/137.1, 137.15
See application file for complete search history.

(56) References Cited

U.S. PATENT DOCUMENTS 5,362,592 A * 11/1994 Murofushi et al. ..... 430/108.14
5,394,231 A * 2/1995 Sudo et al. ..... 399/228
5,766,814 A 6/1998 Baba et al.
6,203,603 B1 * 3/2001 Takayama et al. ..... 106/31.16
6,322,946 B1 * 11/2001 Mahabadi et al. ..... 430/137.12
8,252,496 B2 8/2012 Kabai et al.
8,557,495 B2 10/2013 Kabai et al.
2008/0299475 A1 * 12/2008 Kidokoro ..... 430/108.4
2010/0209839 A1 8/2010 Kabai et al.
2012/0282544 A1 11/2012 Kabai et al.
2012/0282545 A1 11/2012 Kabai et al.

FOREIGN PATENT DOCUMENTS

JP 2000-330321 11/2000
JP 2003-268248 9/2003
JP 2010-191430 9/2010

OTHER PUBLICATIONS

Office Action of Notification of Reason(s) for Refusal for Japanese Patent Application No. 2011-192836 Dated Dec. 17, 2013, 2 pgs.

* cited by examiner

*Primary Examiner* — Stewart Fraser
(74) *Attorney, Agent, or Firm* — Turocy & Watson, LLP

(57) ABSTRACT

Disclosed is a producing method of a decolorizable toner, comprising dispersing a mixed composition containing encapsulated colorant particles which are particles containing a color developable compound and a color developing agent and coated with an outer shell, a polymerizable monomer, and a release agent in an aqueous medium, and subjecting the polymerizable monomer to suspension polymerization in the aqueous medium.

5 Claims, No Drawings

PRODUCING METHOD OF TONER

CROSS-REFERENCE TO RELATED APPLICATION

This application is also based upon and claims the benefit of priority from U.S. provisional application 61/389,892, filed on Oct. 5, 2010; the entire contents of which are incorporated herein by reference.

FIELD

Embodiments described herein relate to a technique for a decolorizable toner.

BACKGROUND

A toner which contains a color developable compound and a color developing agent and can be decolorized is known. When an image is formed using this toner, by heating the printed paper at a temperature between 100 and 200° C. for about 1 to 3 hours, a printed region can be decolorized. The paper in which the printed region was decolorized can be reused, and therefore, this technique can contribute to a decrease in the environmental load by reducing the consumption of paper.

This decolorizable toner can be produced by, for example, melt-kneading a color developable compound and a color developing agent along with a binder resin through a kneading pulverization method, thereby incorporating the color developable compound and the color developing agent in the inside of the toner. However, when a kneading pulverization method is used, kneading is performed at a high temperature between about 100 and 200° C. under a high shearing force, and therefore, a leuco dye (a color developable compound) and a color developing agent are uniformly dispersed in a binder resin, and a reaction between the leuco dye and the color developing agent is inhibited, resulting in decreasing the developed color density of the toner. Further, when a toner material such as a binder resin or a release agent has a decolorizing action, the developed color density of the toner is decreased at the time of kneading in the same manner. Therefore, it is necessary to select a material having a low decolorizing action as a toner material. In particular, as the binder resin, only a specific resin having no decolorizing action such as a styrene-butadiene resin can be used, and it is extremely not easy to use a polyester resin or a styrene acrylic resin having an excellent fixing property because such a resin is liable to exhibit a decolorizing action.

On the other hand, as a production method other than the kneading pulverization method, there is a method for obtaining a toner by, for example, a suspension polymerization method. In this method, however, a leuco dye and a color developing agent are mixed as such with a monomer. Therefore, the method has a problem that if a monomer having a polar group such as a carboxylic acid or a carboxylate ester is used, a color developing reaction between the leuco dye and the color developing agent is inhibited to decrease a developed color density. Accordingly, only a specific monomer which does not inhibit the color developing reaction can be used, and it is not easy to use a monomer with which a binder resin having an excellent fixing property is formed even when a toner is produced by a suspension polymerization method.

DETAILED DESCRIPTION

The producing method of a toner according to one embodiment is a producing method of a decolorizable toner comprising dispersing a mixed composition containing encapsulated colorant particles which are particles containing a color developable compound and a color developing agent and coated with an outer shell, a polymerizable monomer, and a release agent in an aqueous medium and subjecting the polymerizable monomer to suspension polymerization in the aqueous medium.

In this embodiment, first, encapsulated colorant particles (hereinafter also simply referred to as "colorant particles"), a polymerizable monomer, and a release agent are mixed to obtain a mixed composition. Specifically, encapsulated colorant particles and a release agent are dispersed or dissolved in a solvent which is a polymerizable monomer.

At this time, a polymerization initiator, a charge control agent, or the like may be mixed in the mixed composition as needed. Further, a chain transfer agent or a crosslinking agent can be mixed in the mixed composition. When these components are mixed, a dispersing apparatus such as a homogenizer or a bead mill may be used as needed. By using such a dispersing apparatus, the colorant particles or the release agent can be uniformly dispersed.

Further, in this embodiment, it is preferred that before the mixed composition is dispersed in an aqueous medium, which will be described below, the polymerizable monomer in the mixed composition is subjected to bulk polymerization (hereinafter this bulk polymerization is referred to as "preliminary bulk polymerization"). In the preliminary bulk polymerization, for example, the mixed composition is heated in the presence of a polymerization initiator. By polymerizing, for example, 5 to 50% of the polymerizable monomer in the mixed composition through the preliminary bulk polymerization, the polymerizable monomer and a polymer of the monomer coexist in the mixed composition. As a result, the viscosity of the mixed composition is increased as compared with the case where the preliminary bulk polymerization is not performed.

If the viscosity of the mixed composition is increased by the preliminary bulk polymerization, the detachment of the colorant particles from the polymer formed from the polymerizable monomer can be prevented in the dispersion step and the polymerization step which are the subsequent steps. Since the encapsulated colorant particles according to this embodiment have surfaces with high hydrophilicity, the detachment thereof from the toner is more liable to occur than a pigment used in a common toner. Therefore, by suppressing the detachment of the colorant particles from the polymer formed from the polymerizable monomer through the preliminary bulk polymerization, the color development performance of the toner can be further increased.

From the viewpoint of further increasing the color development performance of the toner, the viscosity at 20° C. of the mixed composition after the preliminary bulk polymerization is preferably 0.5 Pa·s or more, more preferably 1 Pa·s or more, further more preferably 45 Pa·s or more. Incidentally, the upper limit of the viscosity thereof is not particularly limited and can be appropriately set by those skilled in the art. However, in order that the dispersing property of the components in the mixed composition can be easily maintained, the viscosity thereof at 20° C. is set preferably to 500 Pa·s or less, more preferably to 100 Pa·s or less. Therefore, the viscosity at 20° C. of the mixed composition after the preliminary bulk polymerization is preferably 0.5 Pa·s or more and 500 Pa·s or less, more preferably 1 Pa·s or more and 100 Pa·s or less, further more preferably 45 Pa·s or more and 100 Pa·s or less. The viscosity can be measured using TVE-22LT (rotor 1°34'× R24) manufactured by Toki Sangyo Co., Ltd.

Incidentally, in the following description, for facilitating understanding, the polymerizable monomer and a polymer of the monomer are collectively referred to as "polymerizable monomer and the like".

Subsequently, an aqueous medium for dispersing the colorant particles, the polymerizable monomer (in the case of performing the preliminary bulk polymerization, the polymerizable monomer and the like), and the release agent is prepared. The aqueous medium refers to water or a mixed solvent which contains water as a main component (the water content is, for example, 80% by mass or more) and in which a solvent dissolving in water such as an alcohol is mixed with water. The aqueous medium is preferably capable of forming toner particles having a uniform particle size distribution, and may contain a dispersing agent as needed. As one example, an aqueous solution containing a dispersing agent, which is one of the aqueous media, can be obtained by dissolving trisodium phosphate and calcium chloride in water and heating the resulting solution to allow a reaction to proceed, thereby producing tricalcium phosphate in water.

Further, if necessary, a surfactant or the like as a dispersing aid may be added to the aqueous medium.

Then, the mixed composition (disperse phase) containing the release agent, the polymerizable monomer and the like, and the colorant particles is dispersed in the aqueous medium (continuous phase). At this time, the particle diameter as a toner is almost determined by the dispersion degree of the disperse phase in the continuous phase. If a toner having a small particle diameter is desired to be produced, it is preferred to use a dispersing apparatus such as a homogenizer or a high-pressure pulverizer.

Subsequently, the suspension polymerization of the polymerizable monomer is performed by heating the continuous phase in which the disperse phase is dispersed while stirring. A reaction condition for the suspension polymerization is not particularly limited and can be appropriately set by those skilled in the art. For example, the reaction temperature can be set to 60° C. to 90° C., and the reaction time can be set to 5 hours to 10 hours. In addition, if necessary, a reaction vessel may be provided with a baffle plate. In this manner, a toner having a sharp particle size distribution can be obtained. Incidentally, the average molecular weight of the polymer formed by the suspension polymerization is not particularly limited and can be appropriately set by those skilled in the art.

After completion of the polymerization, the dispersing agent is dissolved by an acid, and washing and solid-liquid separation are performed, and then, drying and external addition are performed, whereby a toner is obtained.

In this manner, by dispersing the encapsulated colorant particles coated with an outer shell in the aqueous medium along with the polymerizable monomer and the release agent and performing the suspension polymerization of the polymerizable monomer, the color developable compound and the color developing agent are not decolorized by the polymerizable monomer. As a result, a toner which exhibits high color development performance and has an excellent fixing property can be obtained.

The polymerizable monomer to be used in this embodiment can be appropriately selected by those skilled in the art, however, for example, a vinyl-based polymerizable monomer can be used. As the vinyl-based polymerizable monomer, aromatic vinyl monomers such as styrene, methylstyrene, methoxystyrene, phenylstyrene, and chlorostyrene; ester-based monomers such as methyl acrylate, ethyl acrylate, butyl acrylate, methyl methacrylate, ethyl methacrylate, and butyl methacrylate; monomers containing a carboxylic acid such as acrylic acid, methacrylic acid, fumaric acid, or maleic acid; amine-based monomers such as aminoacrylate, acrylamide, methacrylamide, vinylpyridine, and vinyl pyrrolidone; and derivatives thereof can be used alone or by mixing two or more kinds thereof.

The colorant refers to a single compound or a composition that imparts a color to the toner. The encapsulated colorant particles according to this embodiment contain a color developable compound and a color developing agent and are configured such that a core portion containing the color developable compound and the color developing agent is coated with an outer shell (shell material).

The color developable compound is typified by a leuco dye and is an electron donating compound capable of developing a color by the action of a color developing agent. Examples thereof include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindo1-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used by mixing two or more kinds thereof.

The color developing agent which causes the color developable compound to develop a color is an electron accepting compound which donates a proton to the leuco dye. Examples thereof include phenols, metal salts of phenols, metal salts of carboxylic acids, aromatic carboxylic acids, aliphatic carboxylic acids having 2 to 5 carbon atoms, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof. Additional examples thereof include those having, as a substituent, an alkyl group, an aryl group, an acyl group, an alkoxycarbonyl group, a carboxy group or an ester thereof, an amide group, a halogen group, or the like, and bisphenols, trisphenols, phenol-aldehyde condensed resins, and metal salts thereof. These compounds may be used by mixing two or more kinds thereof.

Specific examples thereof include phenol, o-cresol, tertiary butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid or esters thereof such as 2,3-dihydroxybenzoate and methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)-n-hexane, 1,1-bis(4-hydroxyphenyl)-n-heptane, 1,1-bis(4-hydroxyphenyl)-n-octane, 1,1-bis(4-hydroxyphenyl)-n-nonane, 1,1-bis(4-hydroxyphenyl)-n-decane, 1,1-bis(4-hydroxyphenyl)-n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 2,2-bis(4-hydroxyphenyl)-n-heptane 2,2-bis(4-hydroxyphenyl)-n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol, and methylenetris-p-cresol.

Also, an encapsulating agent (shell material) for forming the outer shell of the colorant is not particularly limited and can be appropriately selected by those skilled in the art.

Further, in this embodiment, a decolorizing agent is contained in the ink as needed. As the decolorizing agent, in a three-component system containing a color developable compound, a color developing agent, and a decolorizing agent, a known compound can be used as long as the compound inhibits the color developing reaction between the leuco dye and the color developing agent through heating, thereby making a material colorless.

As the decolorizing agent, particularly, a decolorizing agent which has a temperature hysteresis and is disclosed in JP-A-60-264285, JP-A-2005-1369, JP-A-2008-280523, or the like is preferably used.

If the decolorizing agent having a temperature hysteresis is used, the toner containing the colorant in a color developed state can be decolorized by heating the toner to a specific decolorizing temperature Th or higher. Further, even if the decolorized toner is cooled to a temperature not higher than Th, the decolorized state is maintained. When the temperature of the toner is further decreased, a color developing reaction between the leuco dye and the color developing agent is restored at a specific color restoring temperature Tc or lower and the toner returns to the color developed state, whereby it is possible to cause a reversible color developing and decolorizing reaction. In particular, if the decolorizing agent has a temperature hysteresis in this embodiment, it is preferred that the decolorizing agent satisfies the following relationship: $Th>Tr>Tc$, wherein Tr represents room temperature.

Examples of the decolorizing agent having a temperature hysteresis include alcohols, esters, ketones, ethers, and acid amides.

Particularly preferred are esters. Specific examples thereof include esters of carboxylic acids containing a substituted aromatic ring, esters of carboxylic acids containing an unsubstituted aromatic ring with aliphatic alcohols, esters of carboxylic acids containing a cyclohexyl group in each molecule, esters of fatty acids with unsubstituted aromatic alcohols or phenols, esters of fatty acids with branched aliphatic alcohols, esters of dicarboxylic acids with aromatic alcohols or branched aliphatic alcohols, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These compounds may be used by mixing two or more kinds thereof.

Examples of a method for forming encapsulated colorant particles include an interfacial polymerization method, a coacervation method, an in-situ polymerization method, a submerged drying method, and a submerged curing coating method.

In particular, an in-situ method in which a melamine resin is used as a shell component, an interfacial polymerization method in which a urethane resin is used as a shell component, or the like is preferred.

In the case of an in-situ method, first, the above-mentioned three components (a color developable compound, a color developing agent, and a decolorizing agent to be added as needed) are dissolved and mixed, and then, the resulting mixture is emulsified in an aqueous solution of a water-soluble polymer or a surfactant. Thereafter, an aqueous solution of a melamine formalin prepolymer is added thereto, followed by heating to effect polymerization, whereby encapsulation can be achieved.

In the case of an interfacial polymerization method, the above-mentioned three components and a polyvalent isocyanate prepolymer are dissolved and mixed, and then, the resulting mixture is emulsified in an aqueous solution of a water-soluble polymer or a surfactant. Thereafter, a polyvalent base such as a diamine or a diol is added thereto, followed by heating to effect polymerization, whereby encapsulation can be achieved.

The volume average particle diameter (D50) of the encapsulated colorant particles is not particularly limited, but is preferably 0.5 μm or more and 3.5 μm or less. The mechanism is not exactly known, however, by setting the volume D50 to 0.5 μm or more and 3.5 μm or less when the colorant is encapsulated, the colorant is easily incorporated in the polymer to be formed from the polymerizable monomer as compared with the case where the volume D50 is outside the range. As a result, the color development performance of the toner can be further increased. In addition, by setting the volume D50 of the encapsulated colorant to 0.5 μm or more and 3.5 μm or less, the amount of generated fine powder of the toner can be decreased as compared with the case where the volume D50 is outside the range.

Incidentally, the volume average particle diameter refers to the particle diameter (volume D50) of a particle the value of which is arrived at when the cumulative volume distribution of the particles reaches 50% determined from the sum of the volumes of the individual particles calculated from the particle diameters. The volume average particle diameter can be determined using, for example, Multisizer 3 (aperture diameter: 100 μm, manufactured by Beckman Coulter, Inc.). The volume average particle diameter can be obtained by measuring the diameters of, for example, 50000 particles.

Further, although depending on the specific types of the color developable compound and the color developing agent, by placing the encapsulated colorant at a temperature, for example, between −20° C. and −30° C., the color developable compound and the color developing agent can be coupled to each other to develop a color.

Examples of the release agent include aliphatic hydrocarbon-based waxes such as low-molecular weight polyethylenes, low-molecular weight polypropylenes, polyolefin copolymers, polyolefin waxes, microcrystalline waxes, paraffin waxes, and Fischer-Tropsch waxes; oxides of aliphatic hydrocarbon-based waxes such as polyethylene oxide waxes or block copolymers thereof, vegetable waxes such as candelilla wax, carnauba wax, Japan wax, jojoba wax, and rice wax; animal waxes such as bees wax, lanolin, and spermaceti wax; mineral waxes such as ozokerite, ceresin, and petrolactam; waxes containing, as a main component, a fatty acid ester such as montanic acid ester wax and castor wax; and materials obtained by deoxidization of a part or the whole of a fatty acid ester such as deoxidized carnauba wax. Further, saturated linear fatty acids such as palmitic acid, stearic acid, montanic acid, and long-chain alkyl carboxylic acids having a long-chain alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and long-chain alkyl alcohols having a long-chain alkyl group; polyhydric alcohols such as sorbitol; fatty acid amides such as linoleic acid amide, oleic acid amide, and lauric acid amide; saturated fatty acid bisamides such as methylenebis stearic acid amide, ethylenebis caprylic acid amide, ethylenebis lauric acid amide, and hexamethylenebis stearic acid amide; unsaturated fatty acid amides such as ethylenebis oleic acid amide, hexamethylenebis oleic acid amide, N,N'-dioleyl adipic acid amide, and N,N'-dioleyl sebacic acid amide; aromatic bisamides such as m-xylenebis stearic acid amide, and N,N'-distearyl isophthalic acid amide; fatty acid metal salts (generally called metallic soaps) such as calcium stearate, calcium laurate, zinc stearate, and magnesium stearate; waxes obtained by grafting of a vinyl-based monomer such as styrene or acrylic acid on an aliphatic hydrocarbon-based wax; partially esterified products of a fatty acid and a polyhydric alcohol such as behenic acid monoglyceride; and methyl ester compounds having a hydroxyl group obtained by hydrogenation of a vegetable fat or oil can be exemplified.

Further, a charge control agent, an external additive, or the like can be added as needed.

As the charge control agent, for example, a metal-containing azo compound is used, and the metal element is preferably a complex or a complex salt of iron, cobalt, or chromium, or a mixture thereof. Other than these compounds, a metal-containing salicylic acid derivative compound can also be used, and the metal element is preferably a complex or a complex salt of zirconium, zinc, chromium, or boron, or a mixture thereof.

As an external additive, in order to adjust the fluidity or chargeability of the toner particles, inorganic particles can be added to the surfaces of the toner particles and mixed therewith in an amount of from 0.01 to 20% by mass based on the total mass of the toner. As such inorganic particles, inorganic oxides such as silica, titania, alumina, strontium titanate, and tin oxide can be used alone or by mixing two or more kinds thereof. It is preferred that as the inorganic particles, those surface-treated with a hydrophobizing agent are used from the viewpoint of improvement of environmental stability. Incidentally, the particle diameter of such inorganic particles is not particularly limited and can be appropriately set by those skilled in the art. Further, other than such inorganic oxides, resin particles having a size of 1 μm or less may be externally added for improving the cleaning property.

Further, in this embodiment, for example, a chain transfer agent, a crosslinking agent, a polymerization initiator, a dispersing agent, and a dispersing aid illustrated below can be used in the production of the toner.

As the chain transfer agent, carbon tetrabromide, dodecylmercaptan, trichlorobromomethane, dodecanethiol, or the like is used.

As the crosslinking agent, a compound having two or more unsaturated bonds such as divinyl benzene, divinyl ether, divinyl naphthalene, or diethylene glycol methacrylate is used.

As the polymerization initiator, either of a water-soluble initiator and an oil-soluble initiator can be used. As the water-soluble initiator, for example, a persulfate such as potassium persulfate or ammonium persulfate, an azo-based compound such as 2,2-azobis(2-aminopropane), hydrogen peroxide, benzoyl peroxide, or the like is used. As the oil-soluble initiator, for example, an azo-based compound such as azobisisobutyronitrile or azobisdimethylvaleronitrile or a peroxide such as benzoyl peroxide or dichlorobenzoyl peroxide is used. Further, if necessary, a redox-based initiator can also be used.

As the dispersing agent, either of an inorganic dispersing agent and an organic dispersing agent can be used. Examples of the inorganic dispersing agent include tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersing agent include polyvinyl alcohol, gelatin, methyl cellulose, methylhydroxypropyl cellulose, ethyl cellulose, a sodium salt of carboxymethyl cellulose, and starch.

As the dispersing aid, for example, an anionic surfactant, a cationic surfactant, an amphoteric surfactant, a nonionic surfactant, or the like can be used. Examples of the anionic surfactant include fatty acid salts, alkyl sulfate ester salts, polyoxyethylene alkyl ether sulfate ester salts, alkyl benzene sulfonate salts, alkyl naphthalene sulfonate salts, dialkyl sulfosuccinate salts, alkyl diphenyl ether disulfonate salts, polyoxyehtylene alkyl ether phosphate salts, alkenyl succinate salts, alkane sulfonate salts, naphthalene sulfonic acid formalin condensate salts, aromatic sulfonic acid formalin condensate salts, polycarboxylic acids, and polycarboxylate salts. Examples of the cationic surfactant include alkylamine salts and alkyl quaternary ammonium salts. Examples of the amphoteric surfactant include alkyl betaines and alkylamine oxides. Examples of the nonionic surfactant include polyoxyethylene alkyl ethers, polyoxyalkylene alkyl ethers, polyoxyethylene derivatives, sorbitan fatty acid esters, polyoxyethylene sorbitan fatty acid esters, polyoxyethylene sorbitol fatty acid esters, glycerin fatty acid esters, polyoxyethylene fatty acid esters, polyoxyethylene hydrogenated castor oil, polyoxyethylene alkylamines, and alkyl alkanol amides. These surfactants can be used alone or in combination of two or more.

The dispersing apparatus which can be used in this embodiment is not particularly limited as long as the apparatus can perform pulverization by a wet process. However, examples thereof include high-pressure pulverizers such as Nanomizer (manufactured by Yoshida Kikai Co. Ltd.), Altimizer (manufactured by Sugino Machine Limited), NANO 3000 (manufactured by Beryu Co., Ltd.), Microfluidizer (manufactured by Mizuho Industry Co., Ltd.), and Homogenizer (manufactured by Izumi Food Machinery Co., Ltd.); rotor-stator stirrers such as Ultra Turrax (manufactured by IKA Japan K. K.), T. K. Auto Homo Mixer (manufactured by PRIMIX Corporation), T. K. Pipeline Homo Mixer (manufactured by PRIMIX Corporation), T. K. Filmics (manufactured by PRIMIX Corporation), Clear Mix (manufactured by M Technique Co., Ltd.), Clear SS5 (manufactured by M Technique Co., Ltd.), Cavitron (manufactured by Eurotec Co., Ltd.), and Fine Flow Mill (manufactured by Pacific Machinery & Engineering Co., Ltd.); and media stirrers such as Visco Mill (manufactured by Aimex Co., Ltd.), Apex Mill (manufactured by Kotobuki Industries Co., Ltd.), Star Mill (manufactured by Ashizawa Finetech Co., Ltd.), DCP Superflow (manufactured by Nippon Eirich Co., Ltd.), MP Mill (manufactured by Inoue Manufacturing Co., Ltd.), Spike Mill (manufactured by Inoue Manufacturing Co., Ltd.), Mighty Mill (manufactured by Inoue Manufacturing Co., Ltd.), and SC Mill (manufactured by Mitsui Mining Co., Ltd.).

The toner according to this embodiment can be used in the formation of an image on an electrophotographic recording medium by being placed in an image forming apparatus such as an MFP (multifunction peripheral) as, for example, a non-magnetic one-component developer or two-component developer. If the toner is used in a two-component developer, a carrier which can be used is not particularly limited and can be appropriately selected by those skilled in the art.

In an image forming step, a toner image formed with the toner according to this embodiment transferred onto a recording medium is heated at a fixing temperature, and therefore a resin is melted to penetrate in the recording medium, and thereafter the resin is solidified, whereby an image is formed on the recording medium (fixing treatment).

Further, if the toner contains a colorant containing a color developable compound and a color developing agent, an image formed on a recording medium can be erased by performing a decolorizing treatment of the toner. A specific decolorizing treatment can be performed by heating the recording medium having an image formed thereon at a heating temperature not lower than the decolorizing temperature, thereby decoupling the coupled color developable compound and color developing agent from each other.

EXAMPLES

Hereinafter, the toner according to this embodiment will be described with reference to examples. However, the invention is by no means limited to the following Examples.

Example 1

Preparation of Encapsulated Colorant Particles

Components (colorant materials) composed of 1 part by mass of 3-(2-ethoxy-4-diethylaminophenyl)-3-(1-ethyl-2-methylindol-3-yl)-4-azaphthalide as a leuco dye, 5 parts by mass of 2,2-bis(4-hydroxyphenyl)hexafluoropropane as a color developing agent, and 50 parts by mass of a diester compound of pimelic acid and 2-(4-benzyloxyphenyl)ethanol as a decolorizing agent were dissolved by heating. Then, further a solution obtained by mixing 20 parts by mass of an aromatic polyvalent isocyanate prepolymer and 40 parts by mass of ethyl acetate as encapsulating agents with the above colorant materials was poured into 250 parts by mass of an aqueous solution of 8% polyvinyl alcohol, and the resulting mixture was emulsified and dispersed. After stirring of the dispersion was continued at 70° C. for about hour, 2 parts by mass of a water-soluble aliphatic modified amine as a reaction agent was added thereto, and the stirring of the dispersion was further continued for about 3 hours while maintaining the temperature of the liquid at 90° C., whereby colorless encapsulated particles were obtained. Further, the resulting encapsulated particle dispersion was placed in a freezer (at −30° C.) to develop a color, whereby a dispersion of encapsulated colorant particles (blue colored particles C1) was obtained. The volume average particle diameter of these colored particles C1 was measured using SALD-7000 manufactured by Shimadzu Corporation and found to be 2 μm. Further, the completely decolorizing temperature Th was 79° C. and the completely color developing temperature Tc was −20° C.

Preparation of Disperse Phase Containing Colorant Particles, Polymerizable Monomer, and Release Agent 5 Parts by mass of the above-prepared encapsulated colorant particles, 80 parts by mass of styrene, 9 parts by mass of butyl acrylate, and 1 part by mass of acrylic acid as polymerizable monomers, 4 parts by mass of rice wax as a release agent, and 1 part by mass of 2,2-azobisdimethylvaleronitrile as a polymerization initiator were mixed using a homogenizer T25 manufactured by IKA Japan K. K., and the resulting mixture was subjected to preliminary bulk polymerization at 70° C. for 10 minutes, whereby a disperse phase was prepared. The viscosity of the disperse phase at 20° C. was 2.5 Pa·s.

Preparation of Continuous Phase Containing Dispersing Agent

In 75 parts by mass of ion exchanged water, 18 parts by mass of trisodium phosphate and 7 parts by mass of calcium chloride were dissolved, and a reaction was allowed to proceed at 80° C. for 3 minutes, whereby a continuous phase was prepared.

<Preparation of Toner>

90 Parts by mass of the above-prepared continuous phase and 10 parts by mass of the above-prepared disperse phase were put into a reaction vessel provided with a baffle plate, and the two phases were dispersed at 6500 rpm using a homogenizer T25 manufactured by IKA Japan K. K. Subsequently, the stirring blade was replaced with a paddle blade, and polymerization was allowed to proceed at 80° C. for 8 hours, whereby a toner dispersion liquid was obtained.

Subsequently, to this toner dispersion liquid, citric acid was added to dissolve the inorganic dispersing agent. Then, washing was performed by repeating filtration and washing with ion exchanged water until the electrical conductivity of the filtrate became 50 μS/cm. Thereafter, the washed particles were dried using a vacuum dryer until the water content became 1.0% by mass or less, whereby dried particles (toner base particles) were obtained.

After drying, as additives, 2 parts by mass of hydrophobic silica and 0.5 parts by mass of titanium oxide were attached to the surfaces of the toner base particles, whereby a decolorizable toner was obtained. The particle diameter of the thus obtained toner was measured using Multisizer 3 (aperture: 100 μm) manufactured by Beckman Coulter, Inc. and the 50% number average diameter Dp was found to be 9.5 μm. Further, CV (standard deviation/50% number average diameter Dp) was 32%.

The obtained toner was mixed with a ferrite carrier coated with a silicone resin, and an image was output at an adhesion amount of 0.6 mg/cm$^2$ using an MFP (e-studio 4520c) manufactured by Toshiba Tec Corporation, and as a result, an image with no fogging was obtained. Subsequently, the temperature of the fixing device was set to 70° C., the paper feed rate was adjusted to 30 mm/sec, and a color developed image having an image density of 0.5 was obtained.

By setting the temperature of the fixing device in e-studio 4520c to 100° C. and conveying the obtained color developed image at a paper feed rate of 100 mm/sec, it was confirmed that the image turned into colorless.

The decolorized image was stored in a freezer at −20° C., and it was confirmed that the image density was restored to 0.5 which is equivalent to that before decolorization.

Example 2

A toner was prepared in the same manner as in Example 1 except that the preliminary bulk polymerization was performed at 70° C. for 20 minutes thereby preparing a disperse phase having a viscosity of 45 Pa·s. The particle diameter of the thus obtained toner was measured using Multisizer 3 manufactured by Beckman Coulter, Inc. and the 50% number average diameter Dp was found to be 9.2 μm. Further, CV (standard deviation/50% number average diameter Dp) was 25% and the particle size distribution was very sharp. The image density before decolorization was 0.6.

Example 3

A toner was prepared in the same manner as in Example 1 except that a disperse phase having a viscosity of 0.02 Pa·s was prepared without performing the preliminary bulk polymerization. The particle diameter of the thus obtained toner was measured using Multisizer 3 manufactured by Beckman Coulter, Inc. and the 50% number average diameter Dp was found to be 7.2 μm. Further, CV (standard deviation/50% number average diameter Dp) was 43%, and some colorant particles were detached, and the particle size distribution was broad. The image density before decolorization was 0.4.

Comparative Example 1

Preparation of Disperse Phase Containing Leuco Dye

2 Parts by mass of crystal violet lactone as a leuco dye, 3 parts by mass of propyl gallate as a color developing agent, 80 parts by mass of styrene, 9 parts by mass of butyl acrylate, and 1 part by mass of acrylic acid as polymerizable monomers, 4 parts by mass of rice wax as a release agent, and 1 part by mass of 2,2-azobisdimethylvaleronitrile as a polymerization initiator were mixed using a homogenizer T25 manufactured by IKA Japan K. K., whereby a disperse phase was prepared.

Preparation of Continuous Phase Containing Dispersing Agent

In 75 parts by mass of ion exchanged water, 18 parts by mass of trisodium phosphate and 7 parts by mass of calcium chloride were dissolved, and a reaction was allowed to proceed at 80° C. for 3 minutes, whereby a continuous phase was prepared.

Preparation of Toner Particles

90 Parts by mass of the above-prepared continuous phase and 10 parts by mass of the above-prepared disperse phase were put into a reaction vessel provided with a baffle plate, and the two phases were dispersed at 6500 rpm using a homogenizer T25 manufactured by IKA Japan K. K. Subsequently, the stirring blade was replaced with a paddle blade, and polymerization was allowed to proceed at 80° C. for 8 hours, whereby a toner dispersion liquid was obtained.

Subsequently, to this toner dispersion liquid, citric acid was added to dissolve the inorganic dispersing agent. Then, washing was performed by repeating filtration and washing with ion exchanged water until the electrical conductivity of the filtrate became 50 μS/cm. Thereafter, the washed particles were dried using a vacuum dryer until the water content became 1.0% by mass or less, whereby dried particles were obtained.

After drying, as additives, 2 parts by mass of hydrophobic silica and 0.5 parts by mass of titanium oxide were attached to the surfaces of the toner particles, whereby a decolorizable toner was obtained. The particle diameter of the thus obtained toner was measured using Multisizer 3 manufactured by Beckman Coulter, Inc. and the 50% number average diameter Dp was found to be 8.6 μm. Further, CV (standard deviation/50% number average diameter Dp) was 48%.

The obtained toner was mixed with a ferrite carrier coated with a silicone resin, and an image was output at an adhesion amount of 0.6 mg/cm$^2$ using an MFP (e-studio 4520c) manufactured by Toshiba Tec Corporation, and as a result, an image density was 0.15 and the developed color density was extremely low.

The results of Examples and Comparative Example show that with the use of the producing method of a toner according to this embodiment, a decolorizable toner which exhibits high color development performance and has an excellent fixing property can be provided, and particularly, by performing preliminary bulk polymerization, the color development performance can be further increased.

While certain embodiments have been described, these embodiments have been presented by way of example only, and are not intended to limit the scope of invention. Indeed, the novel method described herein may be embodied in a variety of other forms; furthermore, various omissions, substitutions and changes in the form of the method described herein may be made without departing from the sprit of the inventions. The accompanying claims and their equivalents are intended to cover such forms or modifications as would fall within the scope and spirit of the inventions.

As described in detail above, according to the technique described in this specification, a producing method of a decolorizable toner which exhibits high color development performance and has an excellent fixing property can be provided.

What is claimed is:

1. A producing method of a decolorizable toner, comprising:

forming a mixed composition containing encapsulated colorant particles which are particles containing a color developable compound and a color developing agent and coated with an outer shell and have volume average particle diameter (D50) of 0.5 μm or more and 3.5 μm or less, and a polymerizable monomer by dissolving or dispersing the encapsulated colorant particles in the polymerizable monomer, making coexistence of the polymerizable monomer and a polymer of the monomer in the mixed composition to obtain the mixed composition having a viscosity at 20° C. of 0.5 Pa·s or more and 500 Pa·s or less by subjecting the polymerizable monomer in the mixed composition to bulk polymerization, dispersing the mixed composition which was subjected to the bulk polymerization in an aqueous medium; and subjecting the polymerizable monomer to suspension polymerization in the aqueous medium.

2. The method according to claim 1, wherein the encapsulated colorant particles further contain a decolorizing agent having a temperature hysteresis.

3. The method according to claim 1, wherein the mixed composition is formed by dissolving or dispersing the encapsulated colorant particles and a release agent in the polymerizable monomer.

4. The method according to claim 1, wherein the encapsulated colorant particles further contain a decolorizing agent.

5. The method according to claim 1, wherein the polymerizable monomer is styrene.

* * * * *